US009712922B2

(12) United States Patent
Horii

(10) Patent No.: US 9,712,922 B2
(45) Date of Patent: Jul. 18, 2017

(54) SOUND GENERATOR, VIBRATION MEMBER FOR THE SOUND GENERATOR, AND SOUND GENERATION SYSTEM

(71) Applicant: KYOCERA CORPORATION, Kyoto (JP)

(72) Inventor: Seiji Horii, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 9 days.

(21) Appl. No.: 14/432,639

(22) PCT Filed: Sep. 30, 2013

(86) PCT No.: PCT/JP2013/005808
§ 371 (c)(1),
(2) Date: Mar. 31, 2015

(87) PCT Pub. No.: WO2014/054264
PCT Pub. Date: Apr. 10, 2014

(65) Prior Publication Data

US 2015/0245145 A1 Aug. 27, 2015

(30) Foreign Application Priority Data

Oct. 1, 2012 (JP) ..... 2012-219799

(51) Int. Cl.
*H04R 3/00* (2006.01)
*H04R 17/00* (2006.01)
(Continued)

(52) U.S. Cl.
CPC ..... *H04R 17/005* (2013.01); *H04R 3/04* (2013.01); *H04R 7/045* (2013.01); *H04R 3/00* (2013.01);
(Continued)

(58) Field of Classification Search
CPC ..... H04R 3/00; H04R 3/04; H04R 2400/03; H04R 2499/11; H04R 7/045; H04R 2217/01; H04R 17/005; H04R 17/00
See application file for complete search history.

(56) References Cited

U.S. PATENT DOCUMENTS 6,389,302 B1 * 5/2002 Vance ..... B06B 1/06 455/567
9,020,174 B2 * 4/2015 Åsnes ..... H04R 25/606 181/129
(Continued)

FOREIGN PATENT DOCUMENTS

CN 1784925 6/2006
EP 1978778 A1 10/2008
(Continued)

OTHER PUBLICATIONS

International Search Report; PCT/JP2013/005808; Oct. 29, 2013.
(Continued)

*Primary Examiner* — Muhammad N Edun
(74) *Attorney, Agent, or Firm* — Studebaker & Brackett PC

(57) ABSTRACT

A sound generator includes a vibration unit (60) having a piezoelectric element (61) and also includes a weight (10) for applying a load to the vibration unit (60). The vibration unit (60) deforms based on a sound signal while receiving the load from the weight (10), thereby vibrating a contact surface (150) in contact with the sound generator (10) and generating a sound from the contact surface (150).

10 Claims, 14 Drawing Sheets

(51) Int. Cl.
*H04R 7/04* (2006.01)
*H04R 3/04* (2006.01)

(52) U.S. Cl.
CPC ..... *H04R 17/00* (2013.01); *H04R 2217/01* (2013.01); *H04R 2400/03* (2013.01); *H04R 2499/11* (2013.01)

(56) References Cited

U.S. PATENT DOCUMENTS

| | | | | |
|---|---|---|---|---|
| 9,478,725 | B2 | 10/2016 | Kato | |
| 2005/0029878 | A1 | 2/2005 | Flanagan et al. | |
| 2005/0201584 | A1 | 9/2005 | Smith | |
| 2006/0239479 | A1 | 10/2006 | Schobben et al. | |
| 2007/0041595 | A1* | 2/2007 | Carazo ..... | H04R 17/00 381/151 |
| 2007/0057601 | A1 | 3/2007 | Kawase et al. | |
| 2009/0003630 | A1 | 1/2009 | Kuroda et al. | |
| 2014/0020659 | A1 | 1/2014 | Kato | |

FOREIGN PATENT DOCUMENTS

| | | | |
|---|---|---|---|
| JP | H05-85192 | U | 11/1993 |
| JP | H09-252496 | A | 9/1997 |
| JP | 2000-312394 | A | 11/2000 |
| JP | 2004-527168 | A | 9/2004 |
| JP | 2006-253735 | A | 9/2006 |
| JP | 2006-525734 | A | 11/2006 |
| JP | 2007-074663 | A | 3/2007 |
| JP | 2007-189578 | A | 7/2007 |
| JP | 2008-263080 | A | 10/2008 |
| JP | 2009-027320 | A | 2/2009 |
| JP | 2009-027413 | A | 2/2009 |
| JP | 2011-071691 | A | 4/2011 |
| JP | 2012-028870 | A | 2/2012 |
| WO | 2004/100600 | A2 | 11/2004 |
| WO | 2007/086524 | A1 | 8/2007 |
| WO | 2012/060235 | A1 | 5/2012 |
| WO | 2012/115230 | A1 | 8/2012 |

OTHER PUBLICATIONS

Written Opinion of the International Searching Authority; PCT/JP2013/005808; Oct. 29, 2013; with concise explanation.

The extended European search report issued by the European Patent Office on May 6, 2016, which corresponds to European Patent Application No. 13844492.8-1901 and is related to U.S. Appl. No. 14/432,639.

CN Office Action dated Feb. 4, 2017 from corresponding CN Appl No. 201380051318.6, with English translation, 15 pp.

JP Office Action dated Apr. 4, 2016 from JP Appl No. 2012-219799, with English statement of relevance, 5 pages.

* cited by examiner

SOUND GENERATOR, VIBRATION MEMBER FOR THE SOUND GENERATOR, AND SOUND GENERATION SYSTEM

CROSS REFERENCE TO RELATED APPLICATION

This application claims priority to and the benefit of Japanese Patent Application No. 2012-219799 filed on Oct. 1, 2012, the entire contents of which are incorporated herein by reference.

TECHNICAL FIELD

The present invention relates to a sound generator for vibrating a contact surface in contact with the sound generator and thereby causing the contact surface to generate a sound, a vibration member for the sound generator, and a sound generation system.

BACKGROUND

As a conventional vibration generator, there is one, for example, described in PLT 1 set forth below. The PLT 1 describes a vibration generator having a dynamic speaker structure including a case accommodating a magnet, a voice coil, and a diaphragm. Also, PLT 2 set forth below discloses a vibration generator including a weight made of an elastic body that is deformed in a bending manner or the like by vibration of a piezoelectric vibrator, thereby vibrating a vibrated member. Also, PLT 3 set forth below discloses a vibration generator including an elastic member that receives a load of a weight and is deformed in the bending manner or the like by vibration of the piezoelectric vibrator, thereby vibrating the vibrated member. Further, PLT 4 set forth below discloses a vibration generator including an elastic member that is deformed in the bending manner or the like by vibration of the piezoelectric vibrator, thereby vibrating the vibrated member.

CITATION LIST

Patent Literatures

PTL 1: Japanese Unexamined Utility Model (Registration) Application Publication No. 5-85192

PTL 2: Japanese Patent Application Laid-Open Publication No. 2007-74663

PTL 3: Japanese Patent Application Laid-Open Publication No. 2009-27413

PTL 4: Japanese Patent Application Laid-Open Publication No. 2009-27320

Since the vibration generator described in the PLT 1 having the dynamic speaker structure and various members including the case accommodating the magnet, the voice coil, and the diaphragm, a large number of components is inevitably used to constitute the vibration generator. Also, the vibration generators described in the PLT 2 to the PLT 4 use a piezoelectric element as the vibrator, and these vibration generators need to have a space therein in order to ensure the freedom of the deformation of the elastic body. Therefore, an increase in size of these vibration generators is unavoidable.

In view of the above problems, the present invention is to provide a sound generator a vibration member for the sound generator, and a sound generation system that may be easily configured.

SUMMARY

In order to achieve the above, a sound generator according to the present invention includes:

a vibration unit having a piezoelectric element; and a weight configured to apply a load to the vibration unit, wherein the vibration unit deforms according to a sound signal while receiving the load from the weight, causing vibration of a contact surface in contact with the sound generator, wherein a sound is generated from the contact surface.

The piezoelectric element is a laminated piezoelectric element and deforms in a stretching and contracting manner along a lamination direction.

The vibration unit may have a cover member configured to vibrate the contact surface by transmitting the vibration caused by the deformation of the piezoelectric element to the contact surface.

The sound signal may be a signal having at least a portion of a frequency component higher than a predetermined threshold being cut or attenuated.

The sound signal may be a signal having an attenuation rate that, as the frequency becomes higher than the predetermined threshold, becomes higher gradually or in a stepwise manner.

The sound signal may be a signal having at least a portion of the frequency component higher than the predetermined threshold being cut or attenuated by a filter.

The contact surface may be a placing surface on which the sound generator is placed.

The sound signal is a sound signal of music or voice, and the music or the voice may be generated from the contact surface.

In order to achieve the above matter, also, a vibration member for a sound generator according to the present invention includes a piezoelectric element configured to deform according to a sound signal, causing vibration of a contact surface in contact with the vibration member for the sound generator, wherein a sound is generated from the contact surface.

In order to achieve the above matter, further, a sound generation system according to the present invention includes:

a sound generator having a vibration unit with a piezoelectric element and a weight configured to apply a load to the vibration unit; and a contacted member having a contact surface configured to come into contact with the sound generator, wherein the vibration unit deforms according to a sound signal while receiving the load from the weight, causing vibration of a contact surface of the contacted member, wherein a sound is generated from the contact surface.

According to the present invention, the sound generator that may be easily configured, the vibration member for the sound generator, and the sound system may be provided.

DETAILED DESCRIPTION

Hereinafter, embodiments of the present invention will be described with reference to the accompanying drawings.

Figure 1:
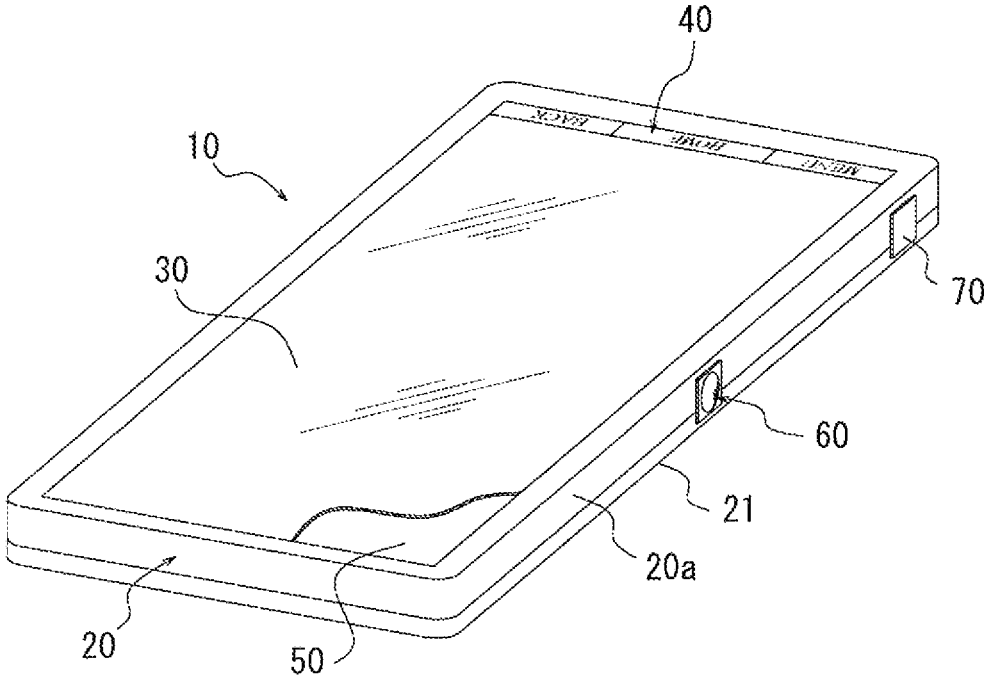
FIG. 1 is an external perspective view of a sound generator according to one embodiment of the present invention.

FIG. 1 is an external perspective view of a sound generator according to one embodiment of the present invention. The sound generator according to the present embodiment includes a mobile phone 10 such as a smart phone, a vibration unit 60, and an elastic member 70. As described later, the mobile phone 10 functions as a weight (a weight of the sound generator) to apply a load to the vibration unit 60. The mobile phone 10 includes a housing 20 of approximately rectangular in appearance shape. In the housing 20, a panel 30 and an input unit 40 are disposed on a front side of the mobile phone 10. As illustrated by a partially cutaway view of the panel 30 in FIG. 1, a display unit 50 is supported under the panel 30. On a rear side of the housing 20, a battery pack, a camera unit and the like are mounted and covered by a battery lid 21.

The panel 30 has a touch panel for detecting a contact, or a cover panel and the like for protecting the display unit 50, and is made of, for example, glass or synthetic resin such as acrylic and the like. The panel 30 has, for example, a rectangular shape. The panel 30 may be a flat plate or a curved panel with a smoothly inclined surface. The panel 30, in case of serving as the touch panel, detects a contact made by a user's finger, a pen, a stylus pen and the like. A detection method of the touch panel may be any one of an electrostatic capacitance method, a resistance film method, a surface acoustic wave method (or an ultrasound method), an infrared method, an electromagnetic induction method, a load detection method, and the like. According to the present embodiment, for convenience of explanation, the panel 30 is assumed as the touch panel.

The input unit 40 receives an operation input from a user and is constituted by using, for example, an operation button (an operation key). Note that the panel 30 also may receive the operation input from the user by detecting the contact made by the user.

The display unit 50 is a display device such as a liquid crystal display, an organic EL display, or an inorganic EL display.

The sound generator according to the present embodiment is provided with, on a side surface 20*a* that is one of longitudinal sides of the housing 20 of the mobile phone 10, a vibration unit 60 for the sound generator and an elastic member 70 that is a sheet-like member. The elastic member 70 is made of, for example, rubber, silicone, polyurethane, or the like. When the mobile phone 10 is placed with the side surface 20*a* facing down on a placing surface of a desk or the like, which is a horizontal surface, that is, when the mobile phone 10 is erected on its side, the mobile phone 10 is supported at two positions by the vibration unit 60 and the elastic member 70 on the placing surface. Arrangements of the vibration unit 60 and the elastic member 70 will be described in detail later.

Figure 2:
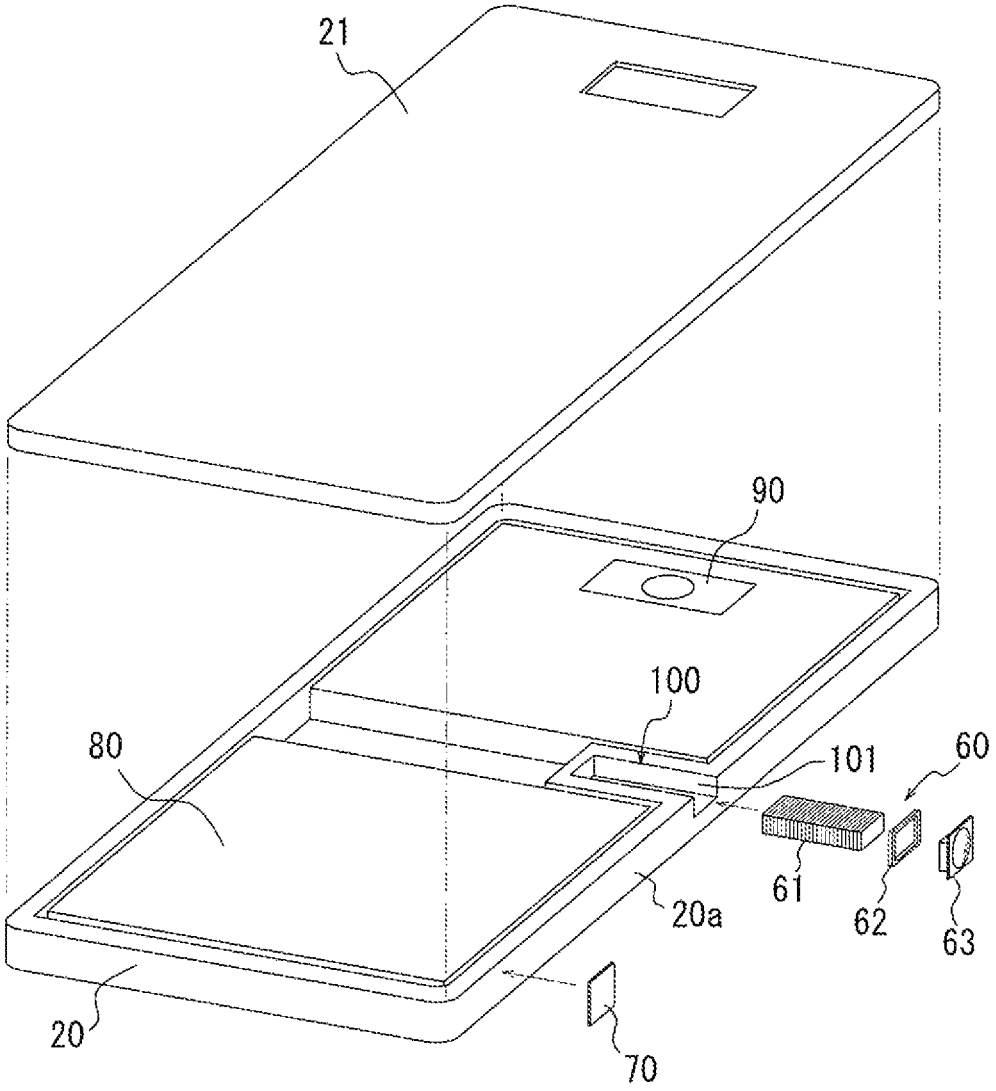
FIG. 2 is a schematic exploded perspective view of a portion of a mobile phone in FIG. 1 on a rear side thereof.

FIG. 2 is a schematic exploded perspective view of a portion of the mobile phone 10 of FIG. 1 on a rear side thereof. On the rear side of the housing 20, a battery pack 80, a camera unit 90 and the like are provided. The mobile phone 10 according to the present embodiment is provided with, on the rear side of the housing 20, a support 100 for accommodating and supporting the vibration unit 60. The support 100 has a slit 101 having a uniform width extending along a short side of the housing 20 and opening to the side surface 20*a*.

The vibration unit 60 includes a piezoelectric element 61, an O-ring 62 used for a waterproof purpose, and a cap 63 having insulating property serving as a covering member. The piezoelectric element is an element that, upon application of an electric signal (a voltage) thereto, stretches/contracts or bends according to an electromechanical coupling coefficient of a constituent material. The piezoelectric element may be made of, for example, ceramic or crystal. The piezoelectric element may be a unimorph, a bimorph, or a laminated piezoelectric element. The laminated piezoelectric element is classified into a laminated bimorph element made up of laminated bimorphs (for example, 16 to 24 layers thereof) or a laminated piezoelectric element of a stack type having a multilayer structure made up of a plurality of dielectric layers made of, for example, PZT (lead zirconate titanate) and electrode layers disposed therebetween. The unimorph stretches/contracts upon application of the electrical signal thereto, while the bimorph bends upon application of the electrical signal thereto. The laminated piezoelectric element of the stack type stretches/contracts along a lamination direction upon application of the electrical signal thereto.

According to the present embodiment, the piezoelectric element 61 is the laminated piezoelectric element of the stack type. The laminated piezoelectric element 61, as illustrated in an enlarged cross-sectional view in FIG. 3A and an enlarged plan view in FIG. 3B, has a structure in which dielectrics 61*a* made of ceramics such as PZT and internal electrodes 61*b* having a sectional comb-shape are laminated alternately. The internal electrode 61*b* connected to a first side electrode 61*c* and the internal electrode 61*b* connected to a second side electrode 61*d* are laminated alternately, thereby being connected to the first side electrode 61*c* and the second side electrode 61*d* alternately.

Figure 3A:
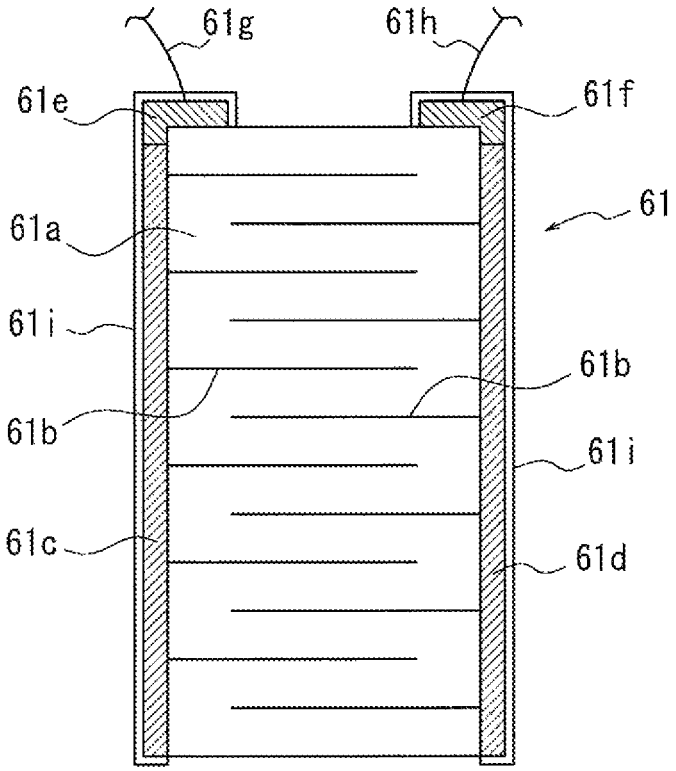
FIGS. 3A and 3B are diagrams illustrating a structure of a laminated piezoelectric element of FIG. 2.
Figure 3B:
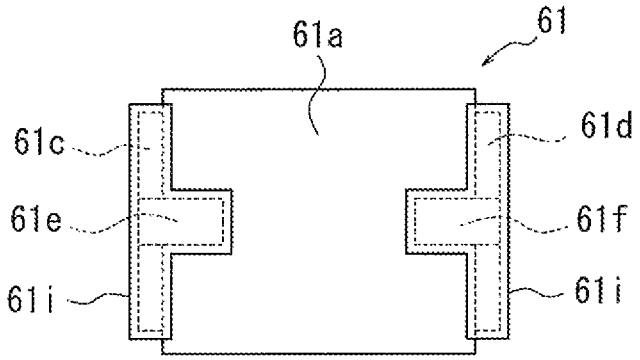

The laminated piezoelectric element 61 illustrated in FIGS. 3A and 3B includes, at one end thereof, a first lead connection portion 61*e* electrically connected to the first side electrode 61*c* and a second lead connection portion 61*f* electrically connected to the second side electrode 61*d* those being formed thereon. The first lead connection portion 61*e* and the second lead connection portion 61*f* are connected to a first lead wire 61*g* and a second lead wire 61*h*, respectively. The first side electrode 61*c*, the second side electrode 61*d*, the first lead connection portion 61*e*, and the second lead connection portion 61*f* are covered by an insulation layer 61*i* while the first lead connection portion 61*e* and the second lead connection portion 61*f* are connected to the first lead wire 61*g* and the second lead wire 61*h*, respectively.

The laminated piezoelectric element 61 has a length of, for example, 5 mm to 120 mm in the lamination direction. A cross-sectional shape of the laminated piezoelectric element 61 in a direction intersecting the lamination direction may be, for example, a substantially square of 2 mm square to 10 mm square, or any shape other than square. The number of dielectrics 61*a* and the internal electrodes 61*b* constituting the laminated piezoelectric element 61 and a cross-sectional area of the laminated piezoelectric element 61 are appropriately determined based on weight of the mobile phone 10 serving as the weight (for example, 80 g to 800 g when the mobile phone 10 is a mobile electronic apparatus), in such a manner as to sufficiently secure a sound pressure or sound quality of a sound generated from the contact surface of the desk or the like in contact with the vibration unit 60.

Figure 6:
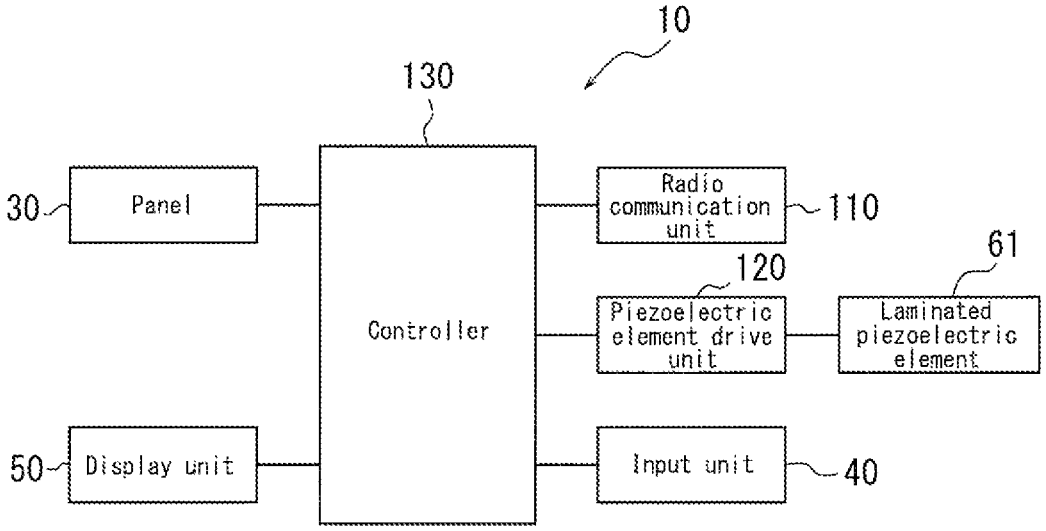
FIG. 6 is a functional block diagram illustrating the portion of the mobile phone of FIG. 1.

To the laminated piezoelectric element 61, as illustrated in FIG. 6, via a piezoelectric element drive unit 120, a sound signal (a reproduction audio signal) is supplied from a controller 130. In other words, a voltage corresponding to the sound signal is applied to the laminated piezoelectric element 61 from the controller 130 via the piezoelectric element drive unit 120. When the voltage applied by the controller 130 is an AC voltage and a positive voltage is applied to the first side electrode 61*c*, a negative voltage is applied to the second side electrode 61*d*. On the other hand, when the negative voltage is applied to the first side electrode 61*c*, the positive voltage is applied to the second side electrode 61*d*. When the voltage is applied to the first side electrode 61*c* and the second side electrode 61*d*, polarization occurs in the dielectric 61*a*, causing the laminated piezoelectric element 61 to stretch/contract from a non-stretching state thereof with no voltage applied thereto. A stretch/contract direction of the laminated piezoelectric element 61 is substantially along the lamination direction of the dielectrics 61*a* and the internal electrodes 61*b*. Alternatively, the stretch/contract direction of the laminated piezoelectric element 61 substantially corresponds to the lamination direction of the dielectrics 61*a* and the internal electrodes 61*b*. Since the laminated piezoelectric element 61 stretches/contracts substantially along the lamination direction, the laminated piezoelectric element 61 is advantageous in providing excellent vibration transmission efficiency.

The laminated piezoelectric element 61 as described above is used for, for example, fuel injection control of a vehicle. The present inventor has conceived that the laminated piezoelectric element 61 as described above is sufficiently effective as a vibration element for generating a sound from the contact surface of the desk or the like in contact with the sound generator.

Figure 4:
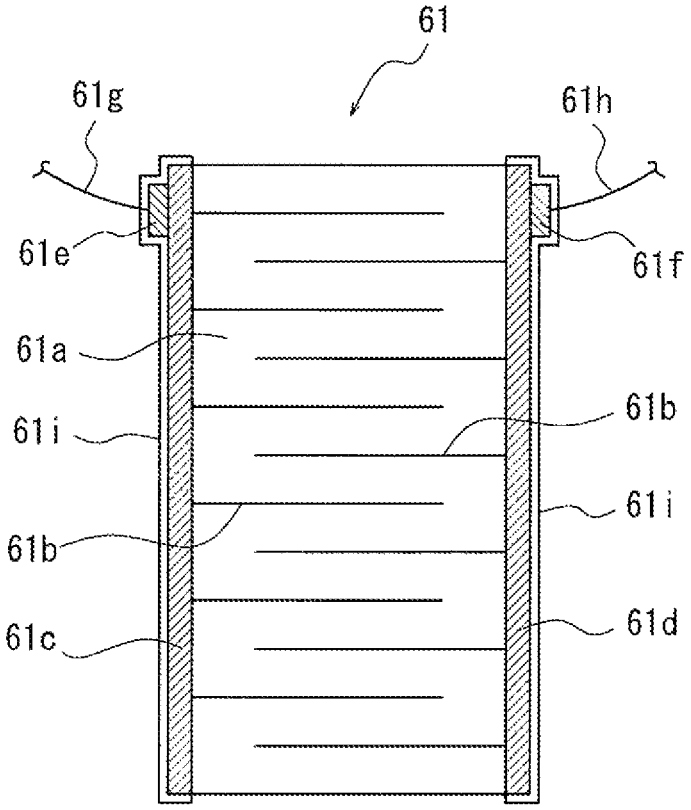
FIG. 4 is a diagram illustrating a variation of the laminated piezoelectric element.

Note that, in FIGS. 3A and 3B, the first side electrode 61*c* and the second side electrode 61*d* may be alternately connected to the internal electrode 61*b* and serve as through-holes connected to the first lead connection portion 61*e* and the second lead connection portion 61*f*, respectively. In FIGS. 3A and 3B, also, the first lead connection portion 61*e* and the second lead connection portion 61*f*, as illustrated in FIG. 4, may be formed on the first side electrode 61*c* and the second side electrode 61*d* at one end of the laminated piezoelectric element 61.

Figure 5:
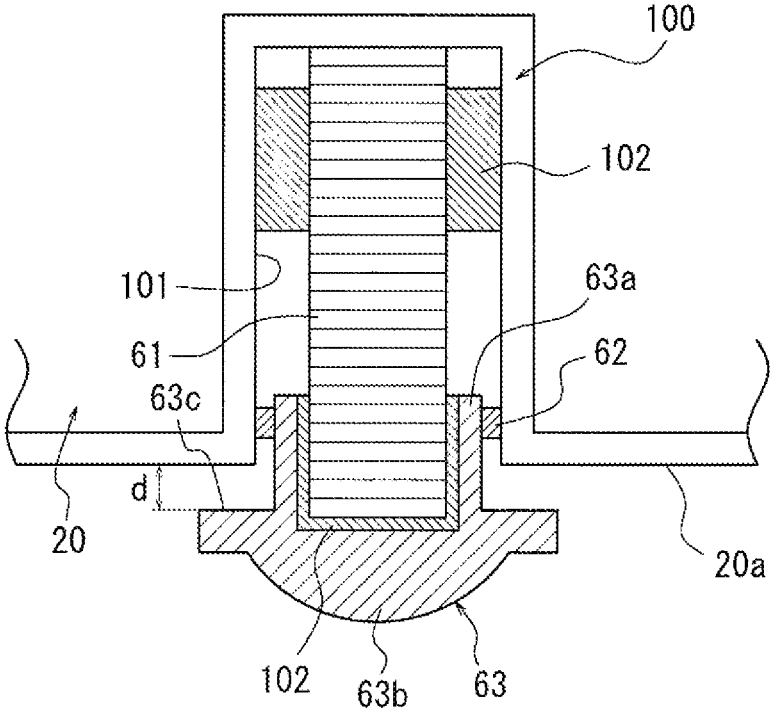
FIG. 5 is a partially enlarged cross-sectional view of a vibration unit of FIG. 1.

The laminated piezoelectric element 61, as illustrated by a partially enlarged cross-sectional view in FIG. 5, includes one end having the first lead connection portion 61*e* and the second lead connection portion 61*f* fixed to the slit 101 of the support 100 of the housing 20 via an adhesive 102 (for example, epoxy resin). At the other end of the laminated piezoelectric element 61, a cap 6 is attached and fixed by the adhesive 102.

The cap 63 is made of a material such as hard plastic or the like that can reliably transmit stretching/contracting vibration of the laminated piezoelectric element 61 to the placing surface (the contact surface) of the desk and the like. When it is preferred to suppress damaging the placing surface, the cap 63 may be made of relatively soft plastic instead of the hard plastic. The cap 63 includes an entry portion 63*a* and a protrusion portion 63*b* formed thereon, such that, with the cap 63 being attached to the laminated piezoelectric element 61, the entry portion 63*a* is positioned inside the slit 101, and the protrusion portion 63*b* protrudes from the housing 20. An O-ring 62 is disposed, for the waterproof purpose, on an outer periphery of the entrance portion 63*a* inside the slit 101. The O-ring 62 is made of, for example, silicone. The O-ring 62 prevents the water and dusts from entering the slit 101. Also, the protruding portion 63*b* has a distal end in a hemispherical shape. Note that the shape of the distal end of the protrusion portion 63*b* is not limited to the hemispherical shape but may be any shape as long as being capable of ensuring point contact or surface contact with the placing surface (the contact surface) of the desk and the like and transmitting the stretching/contracting vibration of the laminated piezoelectric element 61. In FIG. 5, also, gel or the like may be filled in a gap between the O-ring 62 and a portion of the laminated piezoelectric element 61 fixed to the slit 101, so as to enhance a waterproof effect. When the vibration unit 60 is supported by the support 100 and the battery lid 21 is attached to the housing 20, the protrusion portion 63*b* of the cap 63 protrudes from the side surface 20*a* of the housing 20. The protrusion portion 63*b* of the cap 63 includes an opposing surface 63*c* facing the side surface 20*a* of the housing 20. As illustrated in FIG. 5, when the laminated piezoelectric element 61 is not stretching with no voltage is applied thereto, the opposing surface 63*c* is spaced apart from the side surface 20*a* by a distance d.

FIG. 6 is a functional block diagram of the portion of the mobile phone 10 according to the present embodiment. The mobile phone 10 includes, other than the panel 30, the input unit 40, the display unit 50, and the laminated piezoelectric element 61 as described above, a radio communication unit 110, the piezoelectric element drive unit 120, and the controller 130. The panel 30, the input unit 40, the display unit 50, and the radio communication unit 110 are connected to the controller 130. The laminated piezoelectric element 61 is connected to the controller 130 via the piezoelectric element drive unit 120.

The radio communication unit 110 has a known configuration and wirelessly connected to a communication network via a base station. The controller 130 is a processor for controlling overall operations of the mobile phone 10. The controller 130 applies the reproduction audio signal (a voltage corresponding to the reproduction audio signal of voice of the other party or music including ringtone and songs) to the laminated piezoelectric element 61 via the piezoelectric element drive unit 120. The reproduction audio signal may be based on music data stored in an internal memory, or music data stored in an external server or the like to be reproduced via the network.

Figure 7:
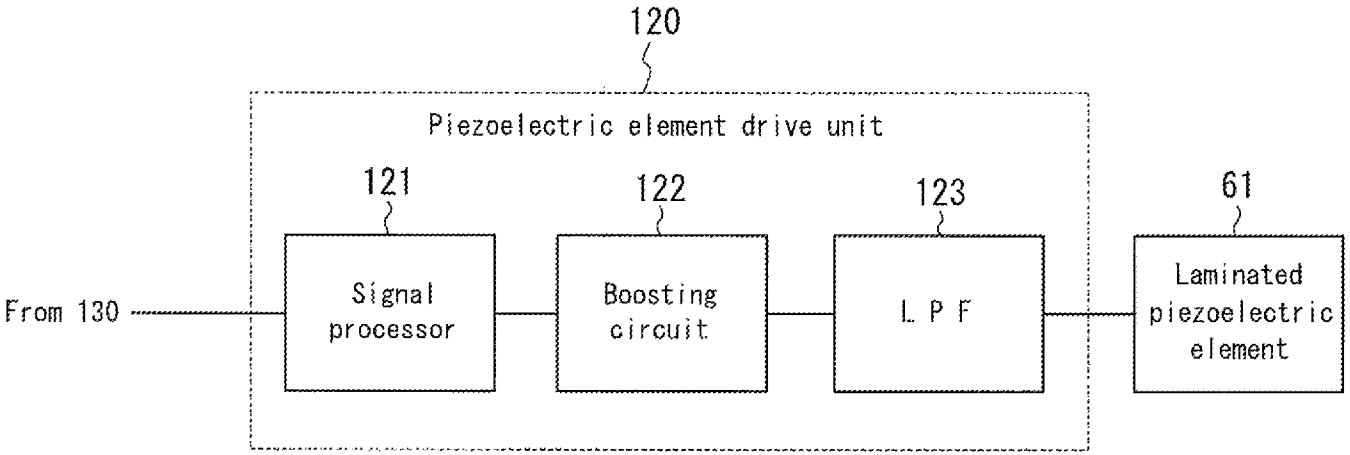
FIG. 7 is a functional block diagram illustrating an example of a configuration of a piezoelectric element drive unit of FIG. 6.

The piezoelectric element drive unit 120, as illustrated in FIG. 7, for example, includes a signal processor 121, a booster circuit 122, and a low-pass filter (LPF) 123. The signal processor 121 is constituted by using a digital signal processor (DSP) or the like that includes, for example, an equalizer, an A/D conversion circuit, and the like. The signal processor 121, by carrying out signal processing as needed such as equalizing processing, D/A conversion processing and the like on a digital signal from the controller 130, generates an analogue reproduction audio signal, and outputs the analogue reproduction audio signal to the boosting circuit 122. Note that the function of the signal processor 121 may be incorporated in the controller 130.

The boosting circuit 122 boosts a voltage of the analogue reproduction audio signal being input and, via the LPF 123, applies the analogue reproduction audio signal to the laminated piezoelectric element 61. Here, a maximum voltage of the reproduction audio signal applied to the laminated piezoelectric element 61 by the boosting circuit 122 may be, for example, 10 Vpp to 50 Vpp. However, the maximum voltage is not limited thereto but may be appropriately adjusted based on the weight of the mobile phone 10 or performance of the laminated piezoelectric element 61. Note that a DC voltage of the reproduction audio signal applied to the laminated piezoelectric element 61 may be biased, and the maximum voltage may be set around such a bias voltage.

Figure 8:
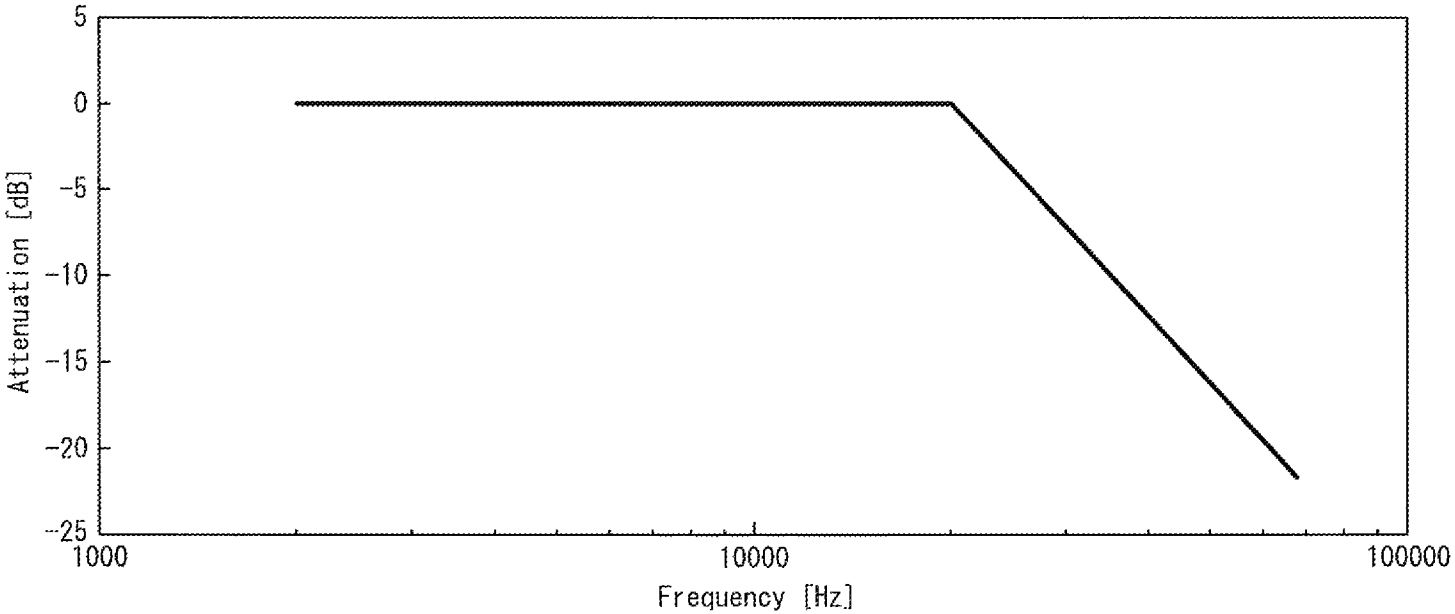
FIG. 8 is a diagram illustrating an example of frequency characteristics of LPF of FIG. 7.

Also, as the frequency becomes higher, not only the laminated piezoelectric element 61 but the piezoelectric elements, in general, have more power loss. Therefore, the LPF 123 is set to have frequency characteristics to attenuate or cut at least a portion of frequency components at approximately 10 kHz to 50 kHz or higher, or frequency characteristics to increase an attenuation rate gradually or in stages. FIG. 8 illustrates, by way of example, the LPF 123 set to have the frequency characteristics with a cutoff frequency at 20 kHz. Attenuation or cut of the high frequency components in this manner allows a reduction in power consumption and suppression of heat generation by the laminated piezoelectric element 61.

Figure 9:
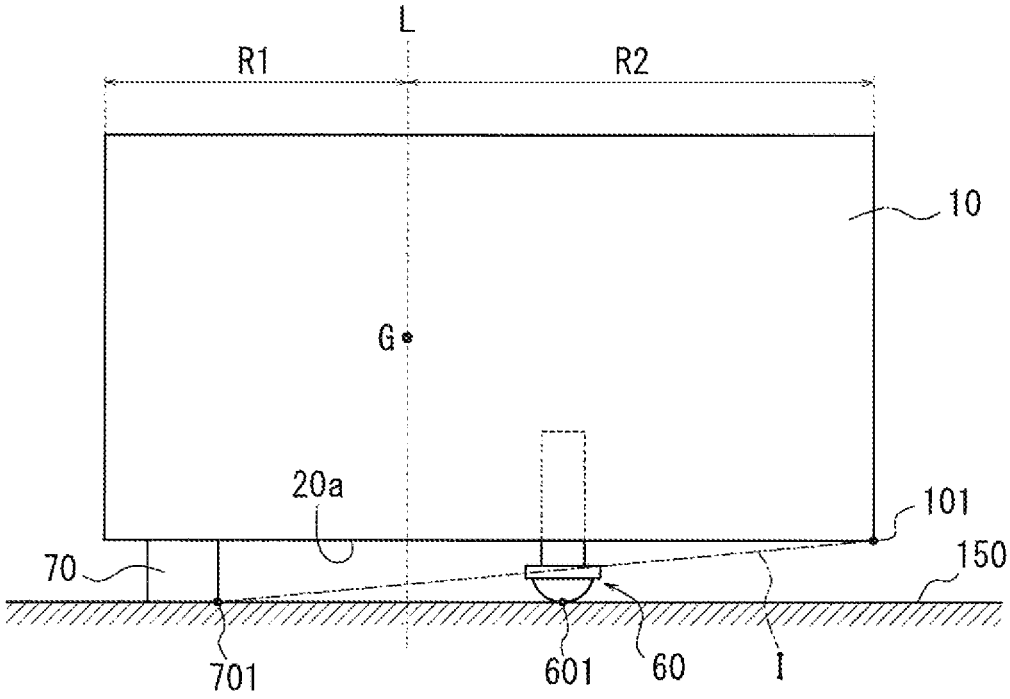
FIG. 9 is a diagram illustrating arrangements of the vibration unit and an elastic member of the sound generator of FIG. 1.

Next, with reference to FIG. 9, the arrangements of the vibration unit 60 and the elastic member 70 will be described. FIG. 9 illustrates the mobile phone 10 placed with the side surface 20*a* facing down on the placing surface 150 of the desk or the like, which is the horizontal surface. Here, the desk is an example of a contacted member, and the placing surface 150 is an example of the contact surface (placing surface) in contact with the sound generator. As illustrated in FIG. 9, the mobile phone 10 is supported at the two positions by the vibrating portion 60 and the elastic member 70 on the placing surface 150. A point G indicates a center of gravity of the mobile phone 10, i.e., a center of gravity of the weight of the sound generator.

In FIG. 9, the elastic member 70 includes a lowermost end portion 701. The lowermost end portion 701 is a portion of the elastic member 70 that contacts with the placing surface 150 when the mobile phone 10 is placed with the side surface 20*a* facing down on the placing surface 150 of the desk or the like.

The vibration unit 60 includes a lowermost end portion 601. The lowermost end portion 601 is a portion of the vibration unit 60 that contacts with the placing surface 150 when the mobile phone 10 is placed with the side surface 20*a* facing down on the placing surface 150 of the desk or the like. The lowermost end portion 601 is, for example, a distal end portion of the cap 63.

The mobile phone 10 includes a lowermost end portion 101. The lowermost end portion 101 is a portion of the mobile phone 10 that contacts with the placing surface 150 when the mobile phone 10 is placed with the side surface 20*a* facing down on the placing surface 150 of the desk or the like, assuming that the vibration unit 60 is omitted. The lowermost end portion 101 of the mobile phone 10 is, for example, a corner of the housing 20 but not limited thereto. When a protrusion portion protruding from the side surface 20*a* is provided thereto, the protrusion portion may serve as the lowermost end portion 101 of the mobile phone 10. The protrusion portion may be, for example, a side key, a connector cap, or the like.

In FIG. 9, a dotted line L represents a line (a virtual line) that is perpendicular to the placing surface 150 and passes through the center of gravity G of the mobile phone 10 when the mobile phone 10 is placed with the side surface 20*a* facing down on the placing surface 150 of the desk or the like. Further, a dashed line I is a line (a virtual line) connecting the lowermost end portion 701 of the elastic member 70 and the lowermost end portion 101 of the mobile phone 10, disregarding the vibration unit 60.

In FIG. 9, a region R1 is one of regions of the mobile phone 10 delimited by the dotted line L. Also, a region R2 is the other region of the mobile phone 10 delimited by the dotted line L. The elastic member 70 is disposed on the side surface 20*a* in the region R1. On the other hand, the vibration unit 60 is disposed on the side surface 20*a* in the region R2.

Preferably, the vibration unit 60, on the side surface 20*a* in the region R2, is disposed as close to the dotted line L as possible. Thereby, the load applied to the vibration unit 60 becomes larger than that when the vibration unit 60 is disposed at a position remote from the dotted line L on the side surface 20*a* in the region R2, allowing effective use of the mobile phone 10 serving as the weight of the sound generator.

Preferably, the elastic member 70, on the side surface 20*a* in the region R1, is disposed as far from the dotted line L as possible. Thereby, when the vibration unit 60 is disposed as close to the dotted line L as possible, a sufficient distance is ensured between the elastic member 70 and the vibrating portion 60, allowing stable placement of the sound generator on the placing surface 150.

The lowermost end portion 601 of the vibration unit 60 preferably locates on the side of the placing surface 150 with respect to the dotted line I when the laminated piezoelectric element 61 stretches maximum from the non-stretching state thereof with no voltage applied thereto, or when amplitude of the laminated piezoelectric element 61 becomes maximum. That is, the lowermost end portion 601 preferably protrudes from the dotted line I toward the placing surface 150 when the laminated piezoelectric element 61 stretches maximum from the non-stretching state thereof with no voltage applied thereto, or when the amplitude the laminated piezoelectric element 61 becomes maximum. Thereby, the vibration unit 60 may appropriately vibrate the placing surface 150.

Further, the lowermost end portion 601 of the vibration unit 60 preferably locates on the side of the placing surface 150 with respect to the dotted line I when the laminated piezoelectric element 61 contracts maximum from the non-stretching state thereof with no voltage applied thereto, or when the amplitude of the laminated piezoelectric element 61 becomes minimum. That is, the lowermost end portion 601 preferably protrudes from the dotted line I toward the placing surface 150 when the laminated piezoelectric element 61 contracts maximum from the non-stretching state thereof with no voltage applied thereto, or when the amplitude of the laminated piezoelectric element 61 becomes minimum. Thereby, the lowermost end portion 101 of the mobile phone 10 is unlikely to contact the placing surface 150 and, for example, some coating of the housing 20 is unlikely to come off. Further, an abnormal noise is unlikely to be generated between the lowermost end portion 101 and the placing surface 150.

Note that, for example, a commercially available stand or the like may be attached to the housing 20, and the mobile phone 10 may be erected with the side surface 20*a* facing down on the placing surface of the desk or the like. In this case, the mobile phone 10 is supported at the two positions by the vibration unit 60 and the elastic member 70 on the side surface 20*a*, and further supported by the stand.

Figure 10A:
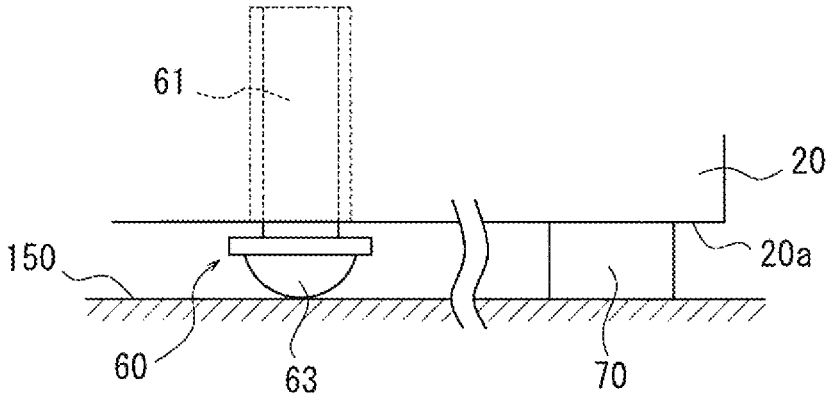
FIGS. 10A, 10B, and 10C are schematic diagrams illustrating a function of the mobile phone of FIG. 1 as the sound generator.
Figure 10B:
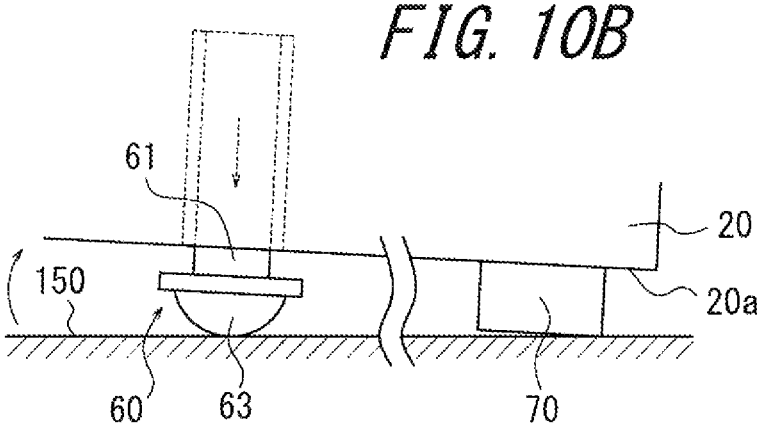
Figure 10C:
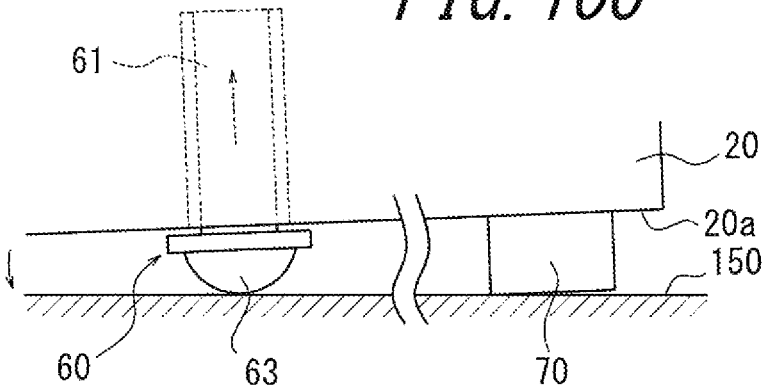

FIGS. 10A, 10B, and 10C are schematic diagrams illustrating a function of the mobile phone 10 according to the present embodiment serving as the sound generator. When the mobile phone 10 serves as the sound generator, the mobile phone 10, as illustrated in FIG. 10A, is erected on its side with the side surface 20*a* of the housing 20 facing down such that the cap 63 of the vibration unit 60 and the elastic member 70 come into contact with the placing surface (the contact surface) 150 of the desk or the like. Thereby, the weight of the mobile phone 10 is applied as the load to the vibration unit 60. That is, the cellular phone 10 serves as the weight of the sound generator. In a state illustrated in FIG. 10A, the laminated piezoelectric element 61 does not stretch/contract, because no voltage is applied thereto.

In this state, when the laminated piezoelectric element 61 of the vibration unit 60 is driven by the reproduction audio signal, the laminated piezoelectric element 61, as illustrated in FIGS. 10B and 10C, performs the stretching/contracting vibration based on the reproduction audio signal having a portion of the elastic member 70 in contact with the placing surface (the contact surface) 150 serving as a supporting point, allowing the cap 63 to remain in contact with the placing surface (the contact surface) 150. Note that, when there is no inconvenience such as generation of the abnormal noise caused by the lowermost end portion 101 coming into contact with the placing surface 150, the cap 63 may be slightly spaced apart from the placing surface 150. A difference between a length of the laminated piezoelectric element 60 stretching maximum and the length of the laminated piezoelectric element 60 contracting maximum is, for example, 0.05 μm to 50 μm. Thereby, the stretching/contracting vibration of the laminated piezoelectric element 61 is transmitted to the placing surface 150 through the mounting cap 63 and vibrates the placing surface 150, and the placing surface 150 serves as a vibration speaker and generates the sound therefrom. When the difference between the length of the laminated piezoelectric element 60 stretching maximum and the length of the laminated piezoelectric element 60 contracting maximum is smaller than 0.05 μm, the placing surface may not be vibrated appropriately. On the other hand, when the difference exceeds 50 μm, the vibration is so large that the sound generator may rattle.

Here, as described above, when the laminated piezoelectric element 61 stretches maximum, the distal end portion of the cap 63 preferably locates on the side of the placing surface 150 with respect to the line (the dashed line I in FIG. 9) connecting the lowermost end portion 701 of the elastic member 70 and the lowermost end portion 101 of the mobile phone 10, disregarding the vibration unit 60. Also, when the laminated piezoelectric element 61 contracts maximum, the distal end portion of the cap 63 preferably locates on the side of the placing surface 150 with respect to the virtual line.

Preferably, the distance d between the side surface 20*a* and an opposing surface 63*c* of the cap 63 illustrated in FIG. 5 is longer than a changing amount of the laminated piezoelectric element 61 between when the laminated piezoelectric element 61 does not stretch with no voltage applied thereto and when the laminated piezoelectric element 61 contracts maximum. Thereby, when the laminated piezoelectric element 61 contracts maximum (in a state illustrated in FIG. 10C), the side surface 20*a* of the housing 20 and the cap 63 are unlikely to come into contact with each other. Accordingly, the cap 63 is unlikely to fall off from the laminated piezoelectric element 61.

The position of the vibration unit 60 on the side surface 20*a*, the length of the laminated piezoelectric element 61 in the lamination direction, and a size of the cap 63 may be appropriately determined so as to satisfy conditions described above.

Using the piezoelectric element as a vibration source, the sound generator of the present embodiment, as compared with relevant vibration generating apparatuses having a dynamic speaker structure, may reduce the number of components thereof, allowing easy configuration. Also, the laminated piezoelectric element 61 of the stack type is used as the piezoelectric element and performs the stretching/contracting vibration in the lamination direction based on the reproduction audio signal, and the stretching/contracting vibration of the laminated piezoelectric element 61 is transmitted to the placing surface (the contact surface) 150. Therefore, the vibration may be efficiently transmitted in a contract direction (deformation direction) to the placing surface (the contact surface) 150, thereby efficiently vibrating the placing surface (the contact surface) 150. Moreover, since the laminated piezoelectric element 61 comes into contact with the placing surface (the contact surface) 150 via the cap 63, the laminated piezoelectric element 61 may be prevented from being damaged. Further, when the mobile phone is erected on its side with the cap 63 of the vibration unit 60 contacting with the placing surface (the contact surface) 150, the weight of the mobile phone 10 is applied as the load to the cap 63. Therefore, the cap 63 may reliably come into contact with the placing surface (the contact surface) 150, efficiently transmitting the stretching/contracting vibration of the vibration unit 60 to the placing surface (the contact surface) 150.

Further, the sound generator of the present embodiment may directly transmit more vibration of the laminated piezoelectric element to the contact surface (the placing surface). Therefore, unlike relevant techniques for transmitting the vibration of the laminated piezoelectric element to another elastic body, at the time of sound generation there is no need to depend on a limit frequency on a high frequency side at which the another elastic body may vibrate. Note that the limit frequency on the high frequency side at which the another elastic body may vibrate takes an inverse of a shortest time from when the another elastic body is deformed by the piezoelectric element to when the another elastic body is restored to be deformable again. In view of this, the weight of the sound generator according to the present embodiment preferably has sufficient rigidity (bending strength) not to be deformed in a bending manner by the deformation of the piezoelectric element.

Figure 11:
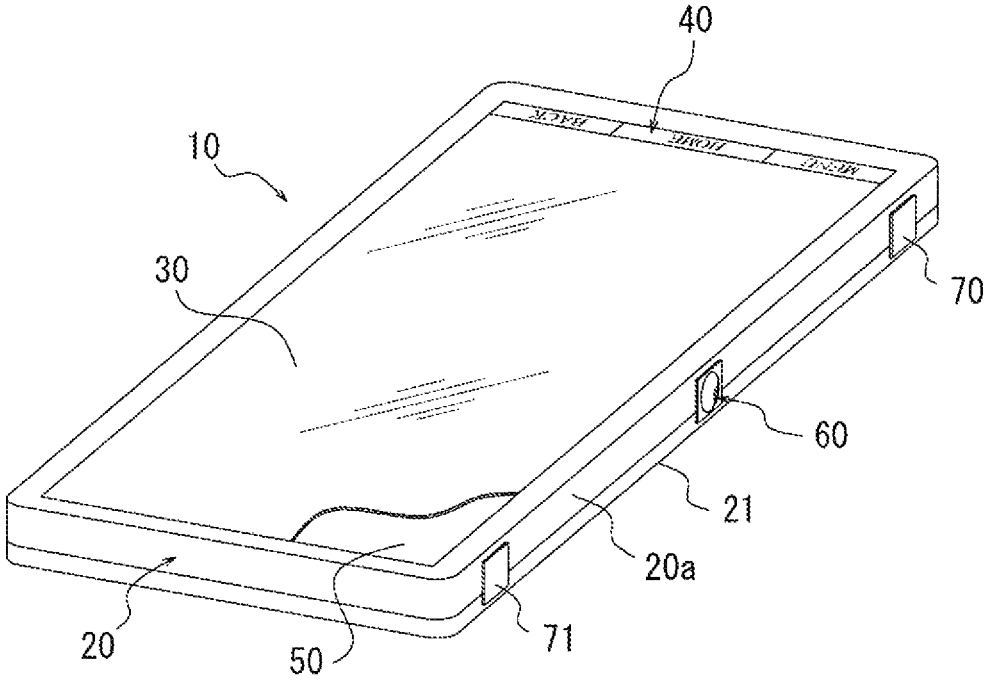
FIG. 11 is a diagram illustrating an external perspective view of a sound generator according to another embodiment of the present invention.

FIG. 11 is a diagram illustrating an external perspective view of a sound generator according to another embodiment of the present invention. Hereinafter, descriptions of the same aspects as those of the embodiment illustrated in FIG. 1 to FIG. 10 will be omitted, and different aspects will be described.

As illustrated in FIG. 11, the mobile phone 10 according to the present embodiment may include an elastic member 71 on the side surface 20*a* of the housing 20. Similarly to the elastic member 70, the elastic member 71 is a sheet-like elastic member made of, for example, rubber, silicone, polyurethane, or the like.

Figure 12:
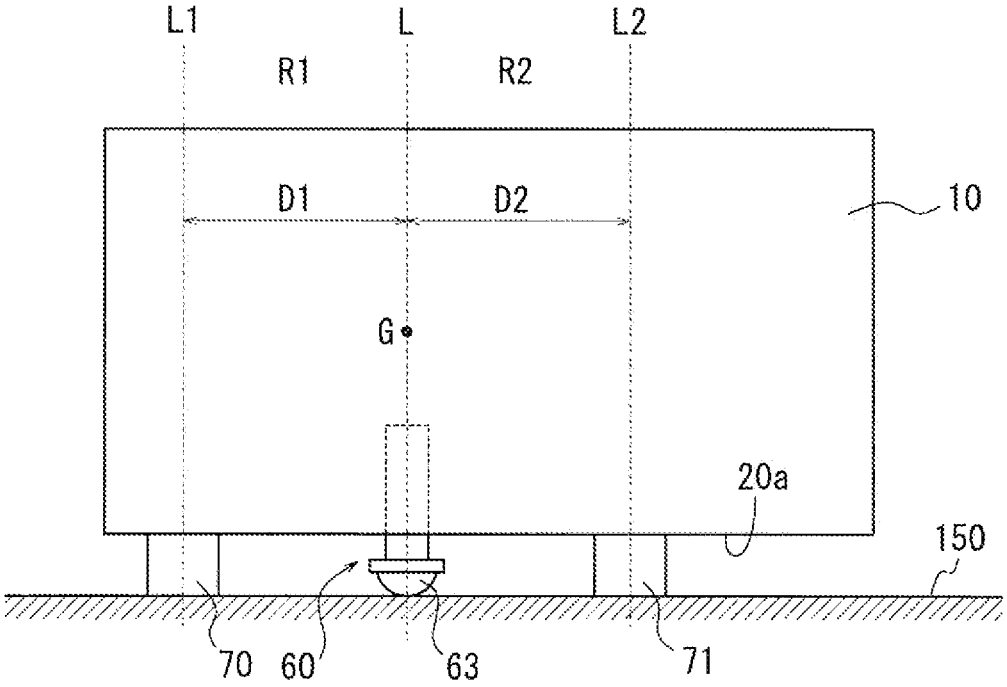
FIG. 12 is a diagram illustrating arrangements of the vibration unit and the elastic member of the sound generator of FIG. 11.

Next, with reference to FIG. 12, arrangements of the vibration unit 60, the elastic member 70, and the elastic member 71 will be described. Similarly to FIG. 9, FIG. 12 illustrates the mobile phone 10 placed with the side surface 20*a* facing down on the placing surface 150 of the desk or the like. As illustrated in FIG. 12, the mobile phone 10 is supported at three positions by the vibration unit 60, the elastic member 70, and the elastic member 71 on the placing surface 150. The point G represents the center of gravity of the mobile phone 10, i.e., the center of gravity of the weight of the sound generator.

In FIG. 12, similarly to FIG. 9, a dotted line L represents the line (the virtual line) that is perpendicular to the placing surface 150 and passes through the center of gravity G of the mobile phone 10 when the mobile phone 10 is placed with the side surface 20*a* facing down on the placing surface 150 of the desk or the like. A dotted line L1 represents the line (the virtual line) that is perpendicular to the placing surface and passes through the elastic member 70. Also, a dotted line L2 represents a line (a virtual line) that is perpendicular to the placing surface and passes through the elastic member 71. The dotted line L1 is spaced apart from the dotted line L in a horizontal direction by a distance D1. The dotted line L2 is spaced apart from the dotted line L in the horizontal direction by a distance D2.

In FIG. 12, a region R1 is one of regions of the mobile phone 10 delimited by the dotted line L, and a region R2 is the other region of the mobile phone 10. The elastic member 70 is disposed on the side surface 20*a* in the region R1 at a position spaced apart from the vibration unit 60 in the horizontal direction by the distance D1. On the other hand, the elastic member 71 is disposed on the side surface 20*a* in the region R2 at a position spaced apart from the vibration unit 60 in the horizontal direction by the distance D2.

The vibration unit 60 is disposed on the dotted line L on the side surface 20*a*. That is, the vibration unit 60 is disposed so as to locate on the line that is perpendicular to the placing surface 150 and passes through the center of gravity G of the mobile phone 10 when the mobile phone 10 is placed with the side surface 20*a* facing down on the placing surface 150 such as a desk and the like. Thereby, the weight of the mobile phone 10 may be applied as the load to the vibration unit 60, and the stretching/contracting vibration of the vibration unit 60 may be efficiently transmitted to the placing surface (the contact surface) 150. Note that, when D1=D2 is satisfied, that is, when the elastic member 70 and the elastic member 71 are disposed symmetrically in the horizontal direction across the vibration unit 60, the sound generator may be stably placed on the placing surface 150.

When the laminated piezoelectric element 61 is driven based on the reproduced audio signal, the vibration unit 60 performs the stretching/contracting vibration based on the reproduced audio signal while the cap 63 remains in contact with the placing surface (the contact surface) 150. Note that, when there is no inconvenience such as the generation of the abnormal noise caused by lower end portions of the elastic member 70 and the elastic member 71 coming into contact with the placing surface 150, the cap 63 may be slightly spaced apart from the placing surface 150.

When the mobile phone 10 is placed with the side surface 20*a* facing down on the placing surface 150 of the desk or the like, the elastic member 70 and the elastic member 71 receive the weight of the mobile phone 10 applied as the load and thus elastically deform. That is, the elastic member 70 and the elastic member 71 contract in a direction perpendicular to the placing surface 150 upon application of the weight of the mobile phone 10 thereto. Preferably, elastic deformation amounts of the elastic member 70 and the elastic member 71 when the laminated piezoelectric element 61 does not stretch with no voltage applied thereto is larger than a deformation amount of the laminated piezoelectric element 61 from when the laminated piezoelectric element 61 does not stretch with no voltage applied thereto to when the laminated piezoelectric element 61 stretches maximum. Thereby, when the laminated piezoelectric element 61 stretches maximum, the elastic member 70 and the elastic member 71 are unlikely to separate from the placing surface 150, allowing the stable placement of the sound generator on the placing surface 150.

Figure 13A:
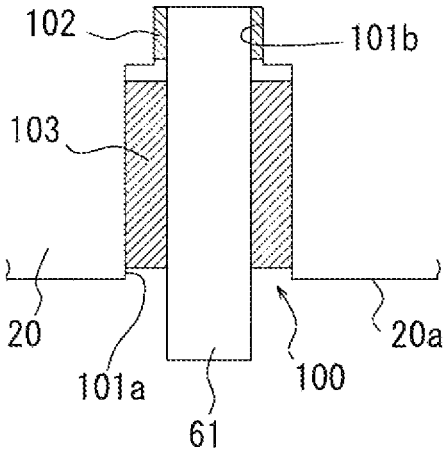
FIGS. 13A, 13B, and 13C are diagrams illustrating three variations of a supporting state of the vibration unit.
Figure 13B:
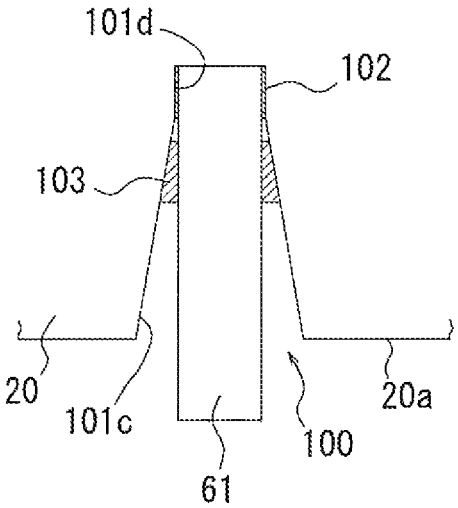
Figure 13C:
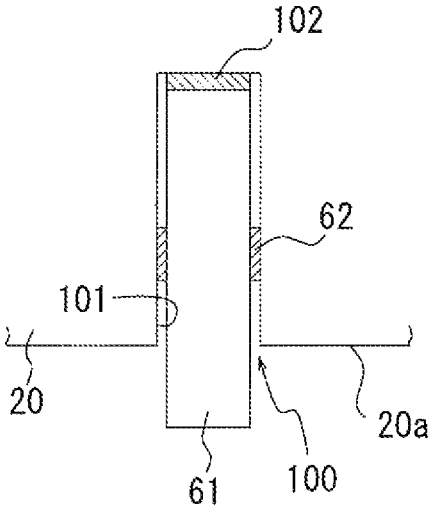

Note that the present invention is not limited to the above embodiments but may be modified or changed in various manners. With reference to FIG. 11, a sound generator according to the another embodiment of the present invention will be described. In the above embodiment, for example, the manner to fix the vibration unit 60 to the supporting portion 100 is not limited to that illustrated in FIG. 5. As illustrated in FIGS. 13A to C, for example, the vibration unit 60 may be supported by the support 100. The support 100 illustrated in FIG. 13A includes a wide slit 101*a* opening to the side surface 20*a* and a narrow slit 101*b* continuing to the wide slit 101*a*. The laminated piezoelectric element 61 has one end portion located in the narrow slit 101*b* and a lateral side secured in the narrow slit 101*b* via the adhesive 102. Further, a gap between the wide slit 101*a* and the laminated piezoelectric element 61 is filled with a filler 103 such as silicone rubber or gel that does not interfere with a stretching motion of the laminated piezoelectric element 61. When the vibration unit 60 is held in the support 100 in this manner, the mobile phone 10 may be reliably waterproofed without using a waterproof packing such as the O-ring. Also, when an insulation cap is attached to a portion of the laminated piezoelectric element 61 protruding from the side surface 20*a*, the laminated piezoelectric element 61 may be reliably insulated.

The support 100 illustrated in FIG. 13B includes a tapered slit 101*c* opening to the side surface 20*a* and a narrow slit 101*d* continuing to the tapered slit 101*c*. The laminated piezoelectric element 61 has one end inserted into the narrow slit 101*d* and fixed thereto via the adhesive 102. Also, a gap between the tapered slit 101*c* and the laminated piezoelectric element 61 is filled with the filler 103 such as the silicone rubber or the gel that does not interfere with the stretching motion of the laminated piezoelectric element 61. This structure offers advantages that the same effect as the support 100 in FIG. 13A may be obtained and that the tapered slit 101*c* allows the laminated piezoelectric element 61 to be easily mounted on the support 100.

The support 100 illustrated in FIG. 13C, similarly to the above embodiment, includes the slit 101 having a uniform width. The laminated piezoelectric element 61 has a surface at one end fixed to the slit 101 via the adhesive 102. Further, the O-ring 62 is provided at an appropriate position on the laminated piezoelectric element 61 within the slit 101. This supporting manner of the laminated piezoelectric element 61 is advantageous especially when the laminated piezoelectric element 61 includes the connection portions of the lead wires formed on the side electrode as illustrated in FIG. 4, in terms of guidance of the lead wires and the like.

Figure 14:
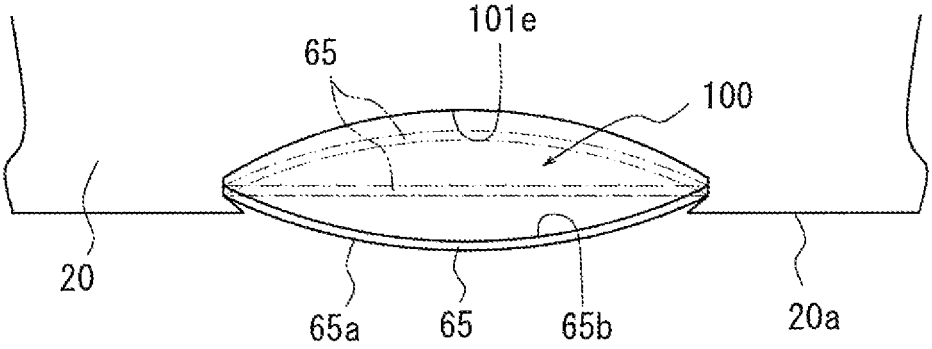
FIG. 14 is a schematic diagram illustrating a structure of the portion for illustrating a variation of the vibration unit.

Further, in the above embodiment and variations illustrated in FIGS. 13A to 13C, the vibration unit 60 may omit the cap 63, and the laminated piezoelectric element 61 may have the distal end to come into contact with the contact surface directly, or via a vibration transmitting member made of an insulation member and the like. Also, the piezoelectric element is not limited to the laminated piezoelectric element of the stack type as described above but may be the unimorph, the bimorph, or the laminated bimorph. FIG. 14 is a diagram illustrating a schematic configuration of the portion using the bimorph. A bimorph 65 has an elongated rectangular shape with one of surfaces 65*a* exposed to the side surface 20*a* of the housing 20 and both longitudinal ends supported by the support member 100. The support member 100 includes an opening portion 101*e* that supports the bimorph 65 and has a curved internal surface facing a rear surface 65*b* of the bimorph 65. According to this structure, when the housing 20 is placed such that the bimorph 65 comes into contact with the placing surface and the bimorph 65 is driven by the reproduction sound signal, the bimorph 65 vibrates in a bending (curving) manner. Thereby, the vibration of the bimorph 65 is transmitted to the placing surface (the contact surface), and the placing surface (the contact surface) functions as the vibration speaker and generates a reproduced sound. Note that the surface 65*a* of the bimorph 65 may have a coating layer made of polyurethane or the like formed thereon.

In FIG. 7, an LPF having the same characteristics as the LPF 123 may be provided between the signal processor 121 and the booster circuit 122. In FIG. 7, also, the equalizer or the like of the signal processor 121 may have the function of the LPF 123 so as to allow omission of the LPF 123.

Although in the above embodiments the vibration unit 60 is disposed on the side surface 20*a* of the housing 20 and protrudes therefrom, the present invention is not limited thereto. Depending on sizes of the housing 20 and the vibration unit 60, the vibration unit 60 may protrude from the battery lid 21, for example.

Also, although in the above embodiments the desk serves as the contacted member and the placing surface of the desk, which is the horizontal surface, serves as the contact surface, the present invention is not limited thereto. The contact surface does not need to be the horizontal surface but may be, for example, a surface of the desk perpendicular to the ground. The contacted member having the surface perpendicular to the ground may be, for example, a partition for separating a space.

Further, although in the above embodiments the sound generator is mounted on the mobile phone 10 serving as the weight, the weight is not limited thereto. For example, various electronic devices such as a portable music player, a stationary TV set, a telephone conference system, a laptop computer, a projector, a wall-mounted clock/TV set, an alarm clock, a photo frame, and the like may serve as the weight, and the sound generator may be mounted thereon. Also, the weight is not limited to the electronic device but may be, for example, a vase, a chair, and the like. Further, the present invention is applicable not only as the sound generator but also as a vibration member for the sound generator having the piezoelectric element, or as a sound generation system that includes the sound generator and the contacted member having the contact surface to come into contact with the sound generator. Note that such variations may be included in the scope of the present invention.

REFERENCE SIGNS LIST

10 mobile phone
20 housing
20*a* side surface
21 battery lid
30 panel
40 input unit
50 display unit
60 vibration unit
61 laminated piezoelectric element (piezoelectric element)
62 O-ring
63 cap
70 elastic member
71 elastic member
100 support
101 slit
102 adhesive
110 radio communication unit
120 piezoelectric element drive unit
121 signal processor
122 booster circuit
123 low-pass filter (LPF)
130 controller
150 placing surface (contact surface)

The invention claimed is:

1. A sound generator comprising:
a vibration unit having a piezoelectric element; and
a weight configured to apply a load to the vibration unit, wherein
the vibration unit deforms according to a sound signal while receiving the load from the weight, causing vibration of a contact surface in contact with the sound generator, wherein a sound is generated from the contact surface,
the contact surface belongs to a separate body from the sound generator other than a human body,
the contact surface is made to function as a speaker, and
the piezoelectric element is of a stack type having a multilayer structure.

2. The sound generator according to claim 1, wherein
the piezoelectric element is a laminated piezoelectric element and deforms in a stretching and contracting manner along a lamination direction.

3. The sound generator according to claim 1, wherein
the vibration unit has a cover member configured to vibrate the contact surface by transmitting the vibration caused by the deformation of the piezoelectric element to the contact surface.

4. The sound generator according to claim 1, wherein
the sound signal is a signal having at least a portion of a frequency component higher than a predetermined threshold being cut or attenuated.

5. The sound generator according to claim 4, wherein
the sound signal may be a signal having an attenuation rate that, as the frequency becomes higher than the predetermined threshold, becomes higher gradually or in a stepwise manner.

6. The sound generator according to claim 4, wherein
the sound signal may be a signal having at least a portion of the frequency component higher than the predetermined threshold being cut or attenuated by a filter.

7. The sound generator according to claim 1, wherein the contact surface is a placing surface on which the sound generator is placed.

8. The sound generator according to claim 1, wherein the sound signal is a sound signal of music or voice, and the music or the voice is generated from the contact surface.

9. A vibration member for a sound generator comprising:

a piezoelectric element configured to deform according to a sound signal, causing vibration of a contact surface in contact with the vibration member for the sound generator, wherein a sound is generated from the contact surface, wherein the contact surface belongs to a separate body from the sound generator other than a human body, the contact surface is made to function as a speaker, and the piezoelectric element is of a stack type having a multilayer structure.

10. A sound generation system comprising:

a sound generator having a vibration unit with a piezoelectric element and a weight for applying a load to the vibration unit; and a contacted member having a contact surface configured to come into contact with the sound generator, the contacted member being a separate body from the sound generator other than a human body, wherein the vibration unit deforms according to a sound signal while receiving the load from the weight, causing vibration of a contact surface of the contacted member, wherein a sound is generated from the contact surface, the contact surface is made to function as a speaker, and the piezoelectric element is of a stack type having a multilayer structure.

* * * * *